US006948652B2

(12) United States Patent
Andersson et al.

(10) Patent No.: US 6,948,652 B2
(45) Date of Patent: Sep. 27, 2005

(54) HINGED CLIP FOR GABLE TOP CARTON

(75) Inventors: Peder Andersson, Lund (SE); Craig Boyd, Arlington Heights, IL (US)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/153,951

(22) Filed: May 23, 2002

(65) Prior Publication Data

US 2003/0001004 A1 Jan. 2, 2003

(30) Foreign Application Priority Data

Jun. 27, 2001 (FR) ..... 01 08493

(51) Int. Cl.[7] ..... B65D 43/22
(52) U.S. Cl. ..... 229/125.39; 229/249; 24/305
(58) Field of Search ..... 24/305 R, 562; 229/125.39, 249; 383/69

(56) References Cited

U.S. PATENT DOCUMENTS 3,381,883 A * 5/1968 Harris ..... 229/125.19 X
4,112,541 A * 9/1978 Tetradis ..... 294/165
4,811,465 A * 3/1989 Folkmar ..... 24/30.5 R
4,923,153 A * 5/1990 Matsui et al. ..... 24/30.5 P
5,924,797 A * 7/1999 Netto ..... 383/92
6,139,187 A * 10/2000 Galomb et al. ..... 383/81
6,464,394 B1 * 10/2002 Galomb ..... 383/10

FOREIGN PATENT DOCUMENTS

| | | | | |
|---|---|---|---|---|
| EP | 0863085 | * | 9/1998 | ..... B65D/33/06 |
| EP | 1008524 | * | 6/2000 | ..... B65B/51/04 |
| JP | 6-127557 | * | 6/1994 | ..... B65D/33/16 |
| WO | WO9952779 | * | 10/1999 | ..... B65D/5/44 |

* cited by examiner

*Primary Examiner*—Tri M. Mai
(74) *Attorney, Agent, or Firm*—Welsh & Katz, Ltd.

(57) ABSTRACT

A closing flap or clip is adapted to cap the edge of a carton in a first position and to free the access to a part of the edge in a second position. The flap passes from the first position to the second position by pivoting around a geometric axis that is perpendicular to the carton edge. The flap is formed from two panels or webs that are configured to fit on each of both sides of the edge when in the first position. First ends of the panels are crossed by the geometric axis. The flap has a hinge linking the two webs and includes means for connecting second ends of the opposing webs to their respective first ends.

2 Claims, 7 Drawing Sheets

HINGED CLIP FOR GABLE TOP CARTON

BACKGROUND OF THE INVENTION

The present invention is directed to a closing clip for a carton having with an edge that can be opened, like a paperboard box classically used for the treatment of milk or powdered products. The invention also refers to a carton equipped with a similar panel and to a fabrication process for such a carton.

The use of a handle is known from Stuart, U.S. Pat. No. 3,361,333, for purposes of keeping the upper multifold edge of a cardboard carton closed. Jackson, U.S. Pat. No. 3,217,967 also shows the use of a metal or plastic flap in the shape of a spout and equipped with ridges intended to create a concentration zone with constraints on an upper edge of a paperboard carton in view of the articulation of this flap on this panel. In the traditional approach, such a flap is obtained by extrusion and cutting. The means by which the flap is affixed to the carton is not secure, and sometimes such a flap can become loose during transport or when the carton is exposed for sale, and subject to petty larceny. Moreover, in order to be rigid enough to maintain the edge of the carton effectively closed, the flap must be of a fairly significant thickness, which complicates its manufacture and increases its final cost.

Accordingly, there exists a need for a closing flap which can be manufactured using a totally different approach, and which allows the upper multifold edge of a carton to be kept effectively closed.

BRIEF SUMMARY OF THE INVENTION

A closing clip or flap for a carton having an edge, is intended to cap this edge in a primary position and to free access to a part of this edge in a secondary position. The flap is also designed to pass from the primary position to the secondary position by pivoting around a geometric axis that is perpendicular to the edge.

The flap consists of two panels which can be used in position on all sides of the flap and whose first extremity is crossed by the geometric axis. The flap consists of a hinge connecting the two panels and means of interlocking the secondary extremities of the two opposing panels to the respective first extremities.

The rigidity of the flap is greatly improved by interlocking the ends opposite the area where the pivot is mounted, i.e. the ends closest to the part of the edge most likely to be the pouring edge. The use of a hinge between the two panels of the flap allows a flat molded blank to be considered, before it is enclosed by interlocking the secondary ends of the panels. Such flat molding allows optimization of the thickness of the different parts that constitute the flap, unlike an extrusion process, as had been used in the past.

Accordingly, flap can include a means for of interlocking the panels by cooperation of shapes. In particular a flange element can be included that extends from the first panel of the flap, and a housing provided in the second panel for receiving and pinching shut the flange element.

The secondary extremities of the two flaps of the panels can be formed having thicknesses that are greater than those of the main parts or of the longitudinal edges of the panels. This allows the thicknesses of the parts constituting the flap as a function of their mechanical functions, from which an excess of material at the time of manufacture of the flap, in compliance with the invention.

At the level of its first end, one of the panels of the flap can have an extension extending in the direction that is globally perpendicular to that panel, that is intended to be inserted into a passage of corresponding form provided in the edge of the carton, to form a mechanical articulation axis of the flap on the carton edge. This ensures that the fixation of the flap on the carton is solid, and effectively resists voluntary or involuntary efforts that might loosen the flap from the carton. In such an arrangement, the other panel is advantageously provided with a receptive opening and with a pinching of the extension, which ensures locking the extension within the passage provided in the edge. Specifically, the extension can include a radial flange of a diameter greater than the nominal diameter of the opening.

The flap can be fabricated as a flat blank, the means for interlocking the secondary ends of the panels and, lacking this, the extension that is intended to be introduced into the passage of the edge, can be cast in one piece with the panels and the hinges. A flap fabricated in this way is particularly economical and solid, and its fabrication tolerances are well maintained.

Essentially, the clip is pivotally attached to the top fin of the carton by means of, for example, a rivet. The clip is injection molded in a flat state, that is as a flat blank. It is later applied to the top fin as the cartons or packages exit, for example, a filling machine. The part of the clip that protrudes over the top fin is folded down onto the other side of the fin and is snapped closed. Upon reclosing the package, the clip is turned or rotated back down and maintains the package closed by straddling the top fin.

Interlocking methods can also be provided for passage openings using casting drawers and, lacking this, using the aforementioned extension.

The invention is further directed to a carton, specifically a box made of paperboard, having a multiple edge suitable for those to be opened, which carton is formed with a flap such as that described above. Such a carton is easier to handle, notably after it has been opened, than traditional cartons.

The invention is further directed to a carton manufacturing process as described above, that includes steps of: flat molding a closure flap, by forming two panels and a hinge connecting these two panels; mounting the flap on the carton by introducing, in a groove cut into the edge of the carton, an extension that reaches from the first panel of the flap in a direction globally perpendicular to this flap; folding the flap along the hinge by bringing a second panel to the flap; and consolidating or connecting the two panels, at the level of the ends opposite the areas closest to the extension.

Advantageously, this process can include a step, simultaneous with consolidation or connecting the two panels, that includes consolidating or connecting the second panel and the extension by folding the flap along the hinge, which allows, both at the first and second ends of the panels, a motion which closes the hinge.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
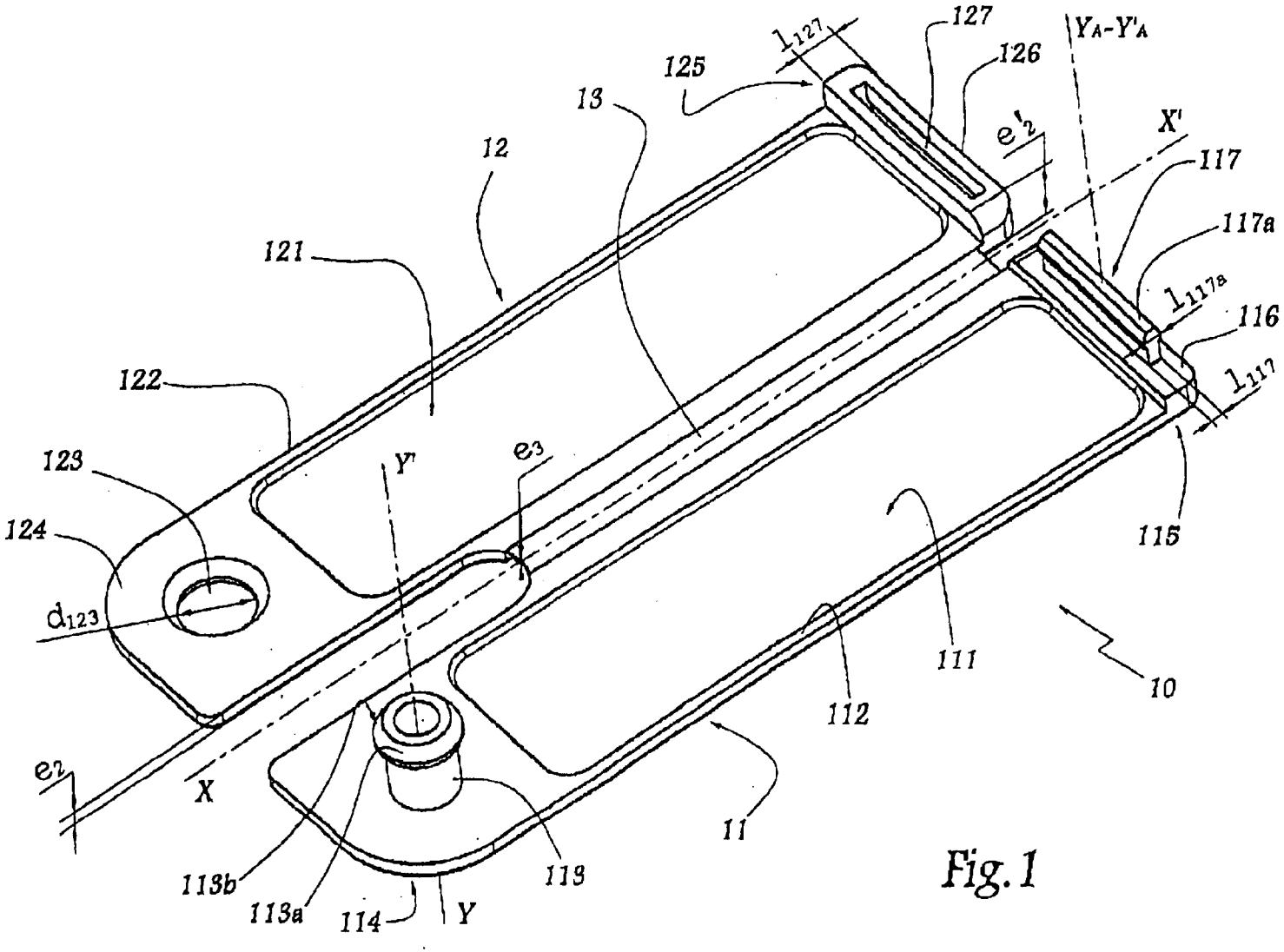
FIG. 1 is a perspective view of a flap or clip embodying the principles of the present invention, the flap being shown in a state before it is mounted on the carton.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, a flap 10 is formed from two panels or webs 11 and 12 connected by a hinge. Flap 10 is molded in the position shown in FIG. 1. The flap is formed as a single block of plastic, e.g. as a unitary element.

Panel 11 features, at its center, a medium-thickness web 111. This web 111 is bounded by longitudinal borders 112 of thickness $e_1$, which are greater than those of the web 111. Similarly, a central web 121 of panel 12 is of a relatively small thickness and is bounded by edges 122 of a greater thickness $e_2$.

The hinge 13 is of a thickness $e_3$ that is less than thicknesses $e_1$ and $e_2$ which are identical or similar to each other. The geometric axis, indicated at X–X' of hinge 13 is indicated here.

Panel 11 features an extension 113, cylindrical in form and equipped with a radial flange 113*a* at its free end 113*b*. Extension 113 is centered on axis Y–Y', which is globally perpendicular to the plane of panel 11 and to axis X–X'. The extension 113 extends from the end 114 of panel 11.

At the end 115 of web 111, opposite end 114, this panel features a projection 116, of thickness $e'_1$, which is greater than thickness $e_1$, from which extends a tab 117. Tab 117 projects, relative to zone 115, in the direction $Y_A$–$Y'_A$ parallel to direction Y–Y', and reaches longitudinally in direction Z–Z', which is noticeably perpendicular to axis X–X' and to direction $Y_A$–$Y'_A$. Tab 117 features a ridge at its end 117*a*, which extends for its whole length.

Panel 12 is provided, at the level of its first end 124, with a circular opening 123 of which the diameter $d_{123}$ is indicated. This diameter is slightly larger than that of the main portion of extension 113 and less than that of the flange 113*a*.

Figure 4:
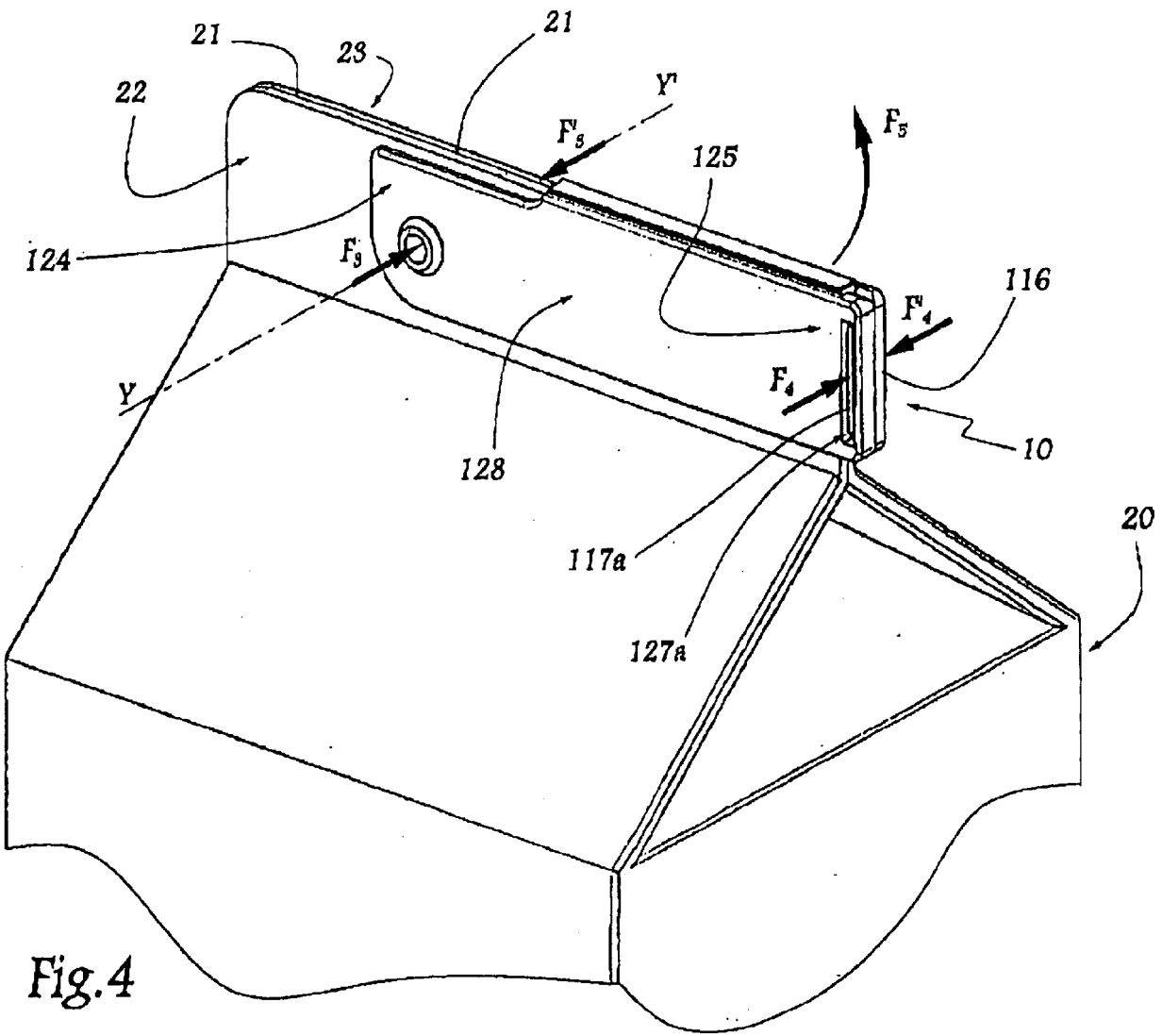
FIG. 4 is a view following that of FIG. 3 in terms of mounting the flap, illustrating the flap in its first utilization position.

Panel 12 features, at its secondary end 125 opposite the first end 124, a projection 126 of thickness $e'_2$ which is greater than the thickness $e_2$ of edges 122. In this projection 126, a groove 127 is provided whose dimensions are such that it can receive the tab 117 when the hinge 13 is folded along axis X–X'. The width $1_{127}$ of the groove 127 is greater than the width $1_{117}$ of the tab 117 at its base and less than the width $1_{117a}$ of ridge 117*a*. In fact, groove 127 has an internal shape which noticeably complies with, e.g., corresponds to the external form of tab 117 and, on the side of panel 12 that is not visible in FIG. 1 but is visible in FIG. 4, shows a wider part 127*a* to receive tab 117*a*. Taking their respective geometries into consideration, tab 117 can be immobilized by cooperation of the shapes in groove 127. In practice, edge 117 can be caught in groove 127.

Figure 5:
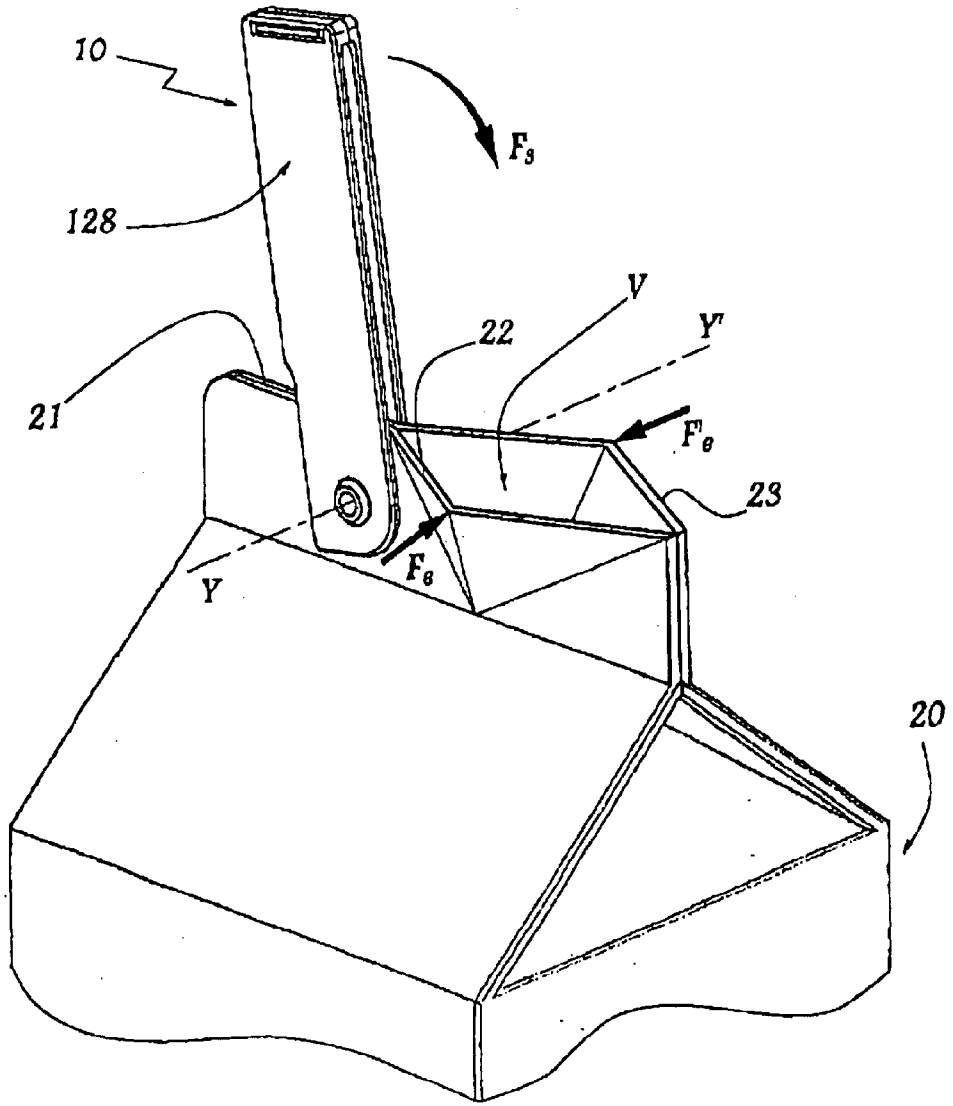
FIG. 5 is a view following that of FIG. 4, showing the flap in its second utilization position.

Mounting the flap 10 on the carton 20 is explicitly referred to in FIGS. 2 to 5. Carton 20 is of a globally parallelipipedic shape and comprises, at its upper portion, an edge 21 which is formed by two paperboard folds 22 and 23. As is shown in FIG. 5, folds 22 and 23 can be separated from each other to form a spout V for the product contained in carton 20.

Figure 2:
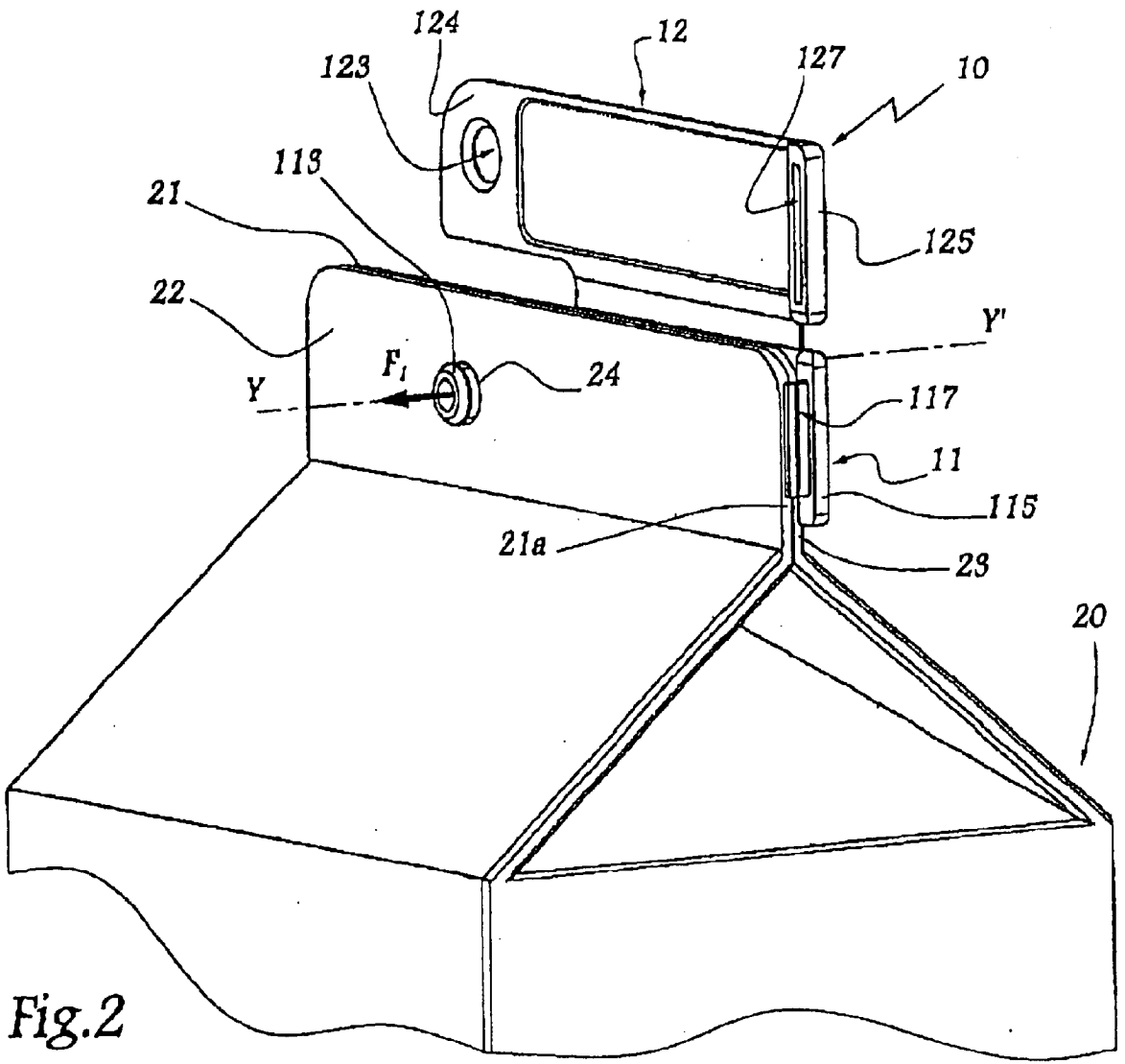
FIG. 2 is a perspective view of the first step in mounting the flap of FIG. 1 to a carton.

Mounting flap 10 on carton 20 is accomplished by introducing extension 113 in a hole 24 formed in edge 21, as represented by arrow $F_1$ in FIG. 2. In this step, and in the following steps, axis Y–Y' is perpendicular to edge 21. In terms of this introduction, panel 11 adjoins edge 21 of the side of fold 23 and tab 117 reaches this immediate area of a border before 21*a* of edge 21.

Figure 3:
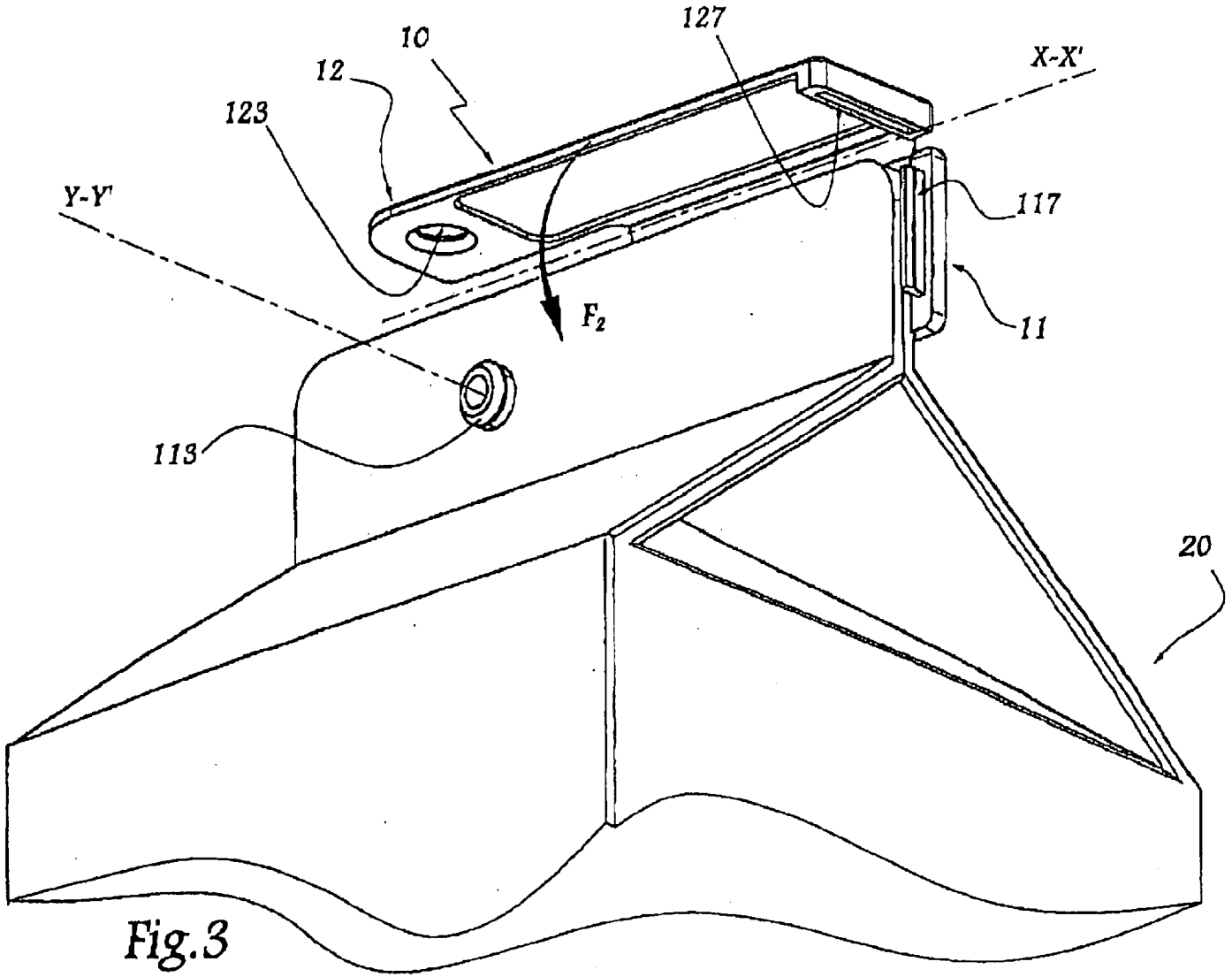
FIG. 3 is a view following that of FIG. 2 illustrating the second step in mounting the flap.

As such, flap 10 is folded along axis X–X' of hinge 13, as represented by arrow $F_2$ in FIG. 3, which allows the use of opening 123 around extension 113 and groove 127 around tab 117.

Introduction of extension 113 into opening 123, and of tab 117 into groove 127, takes place by elastic deformation of panel 10, which is compatible with its constituent material. It is noted here that the movement of folding of flap 10 is a simple movement which can be effected automatically by a robotic manipulator, similar to the movement introducing extension 113 into hole 24 in the direction of arrow $F_1$.

The folding movement in the direction of arrow $F_2$ allows the position in FIG. 4 to be reached, where flap 10 caps edge 21; a tightening motion indicated by arrows $F_3$ and $F'_3$ is exercised by cooperation of flange 113*a* and of opening 123 at the level of the first extremities 114 and 124 of panels 11 and 12, whereas a second tightening motion, indicated by arrows $F_4$ and $F'_4$ is exercised by cooperation of elements 117 and 127 at the level of secondary ends 115 and 125 of panels 11 and 12. Groove 127 extends through extension 125, which allows easy molding of part 127*a* of width $1_{127a}$, which is greater than width $1_{127}$.

When the user needs the contents of carton 20, all s/he has to do is pivot the flap 10 around the geometric axis Y–Y' of extension 113, in the direction of arrow $F_5$ in FIG. 4, which brings flap 10 to the position in FIG. 5 where it does not prevent the separation of folds 22 and 23 to form spout V.

When the consumer wants to close carton 20, all s/he has to do is press folds 22 and 23 against each other, in the direction of arrows $F_6$ and $F'_6$ and to put the cap back on edge 21 with flap 10 with a pivoting movement $F'_5$ in the opposite direction of the previous movement $F_5$. Movements $F_3$, $F'_3$, $F_4$ and $F'_4$ allow edge 21 to be kept in a closed configuration, including the time after folds 22 and 23 have been pulled apart.

Since it is manufactured by a flat blank molding process, flap 10 can be easily adapted, for example as a function of the brand of the product contained in carton 20. In fact, all that needs to be done is to apply inserts into the flap's 10 fabrication mold so that they will appear on the external surfaces of panels 11 and 12, so that surface 128, which is visible in FIGS. 4 and 5, shows technical or advertising notes relating to this product.

Moreover, the roughness of surfaces 128 and their equivalent can be modified at will in order to improve the grip on flap 10.

The process described above can easily be carried out at the time of manufacture of the product contained in carton 20. To this end, the hole 24 can be formed in flap 21 immediately before application of extension 113.

Figure 6:
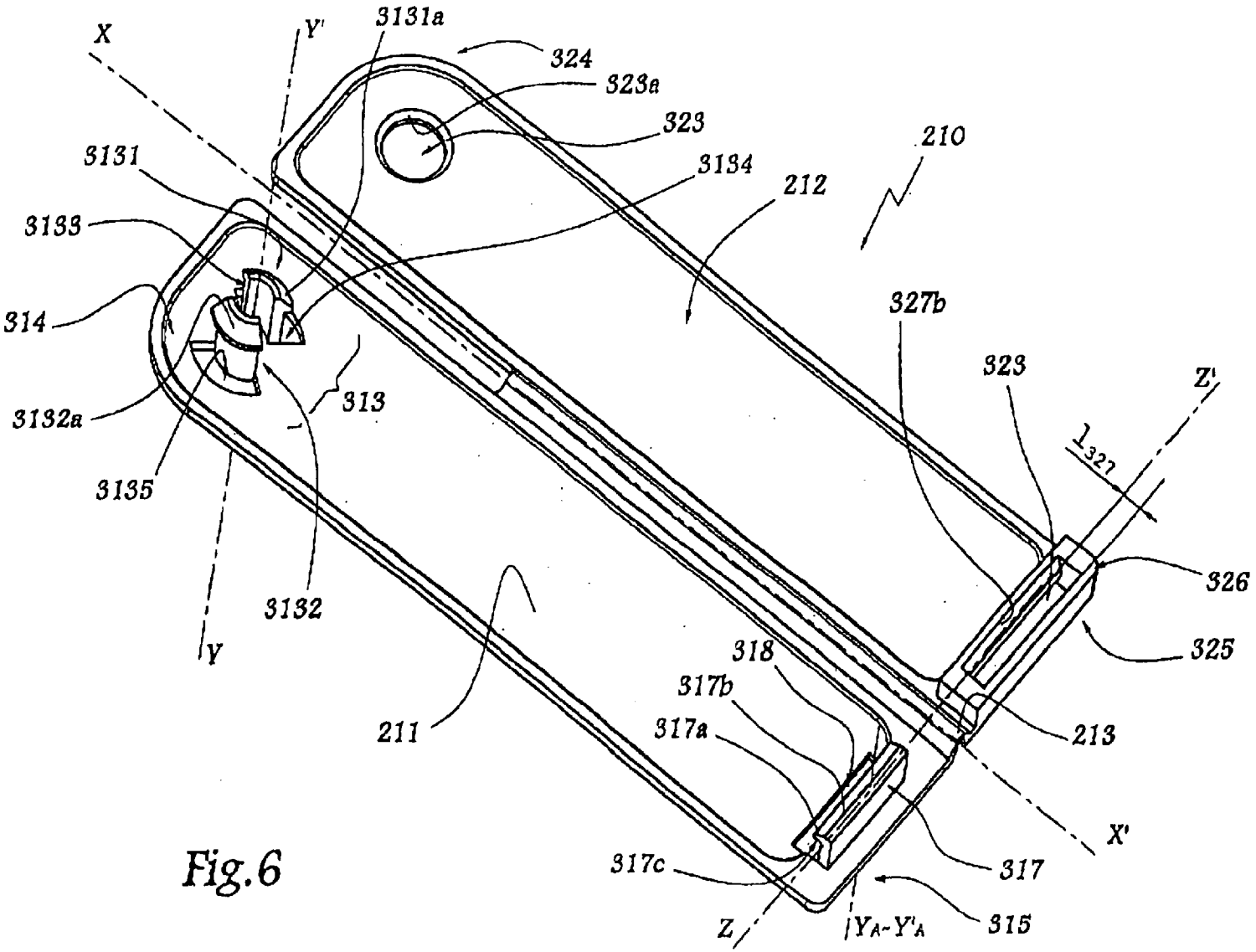
FIG. 6 illustrated an alternate embodiment of the flap in a position similar to that of FIG. 1.
Figure 7:
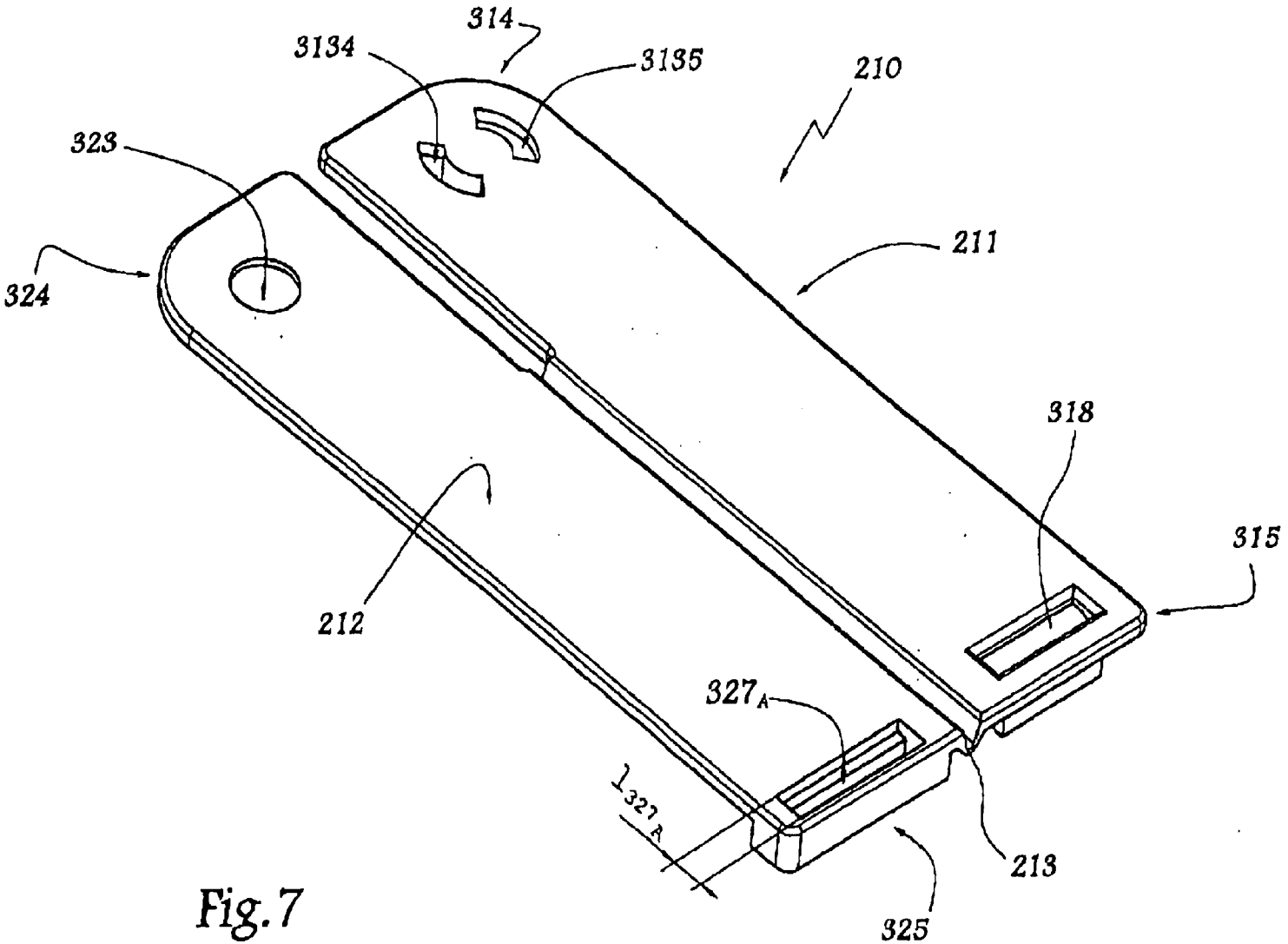
FIG. 7 is a perspective view of the flap of FIG. 6, viewed from the opposite side.

The second embodiment of the flap and the method for making the flap are illustrated in FIGS. 6 and 7, in which like elements have like numbers that are increased in increments of 200 from those that correspond to elements of the previous embodiment and method first production. Flap 210 includes two panels 211 and 212 connected to one another by a hinge 213 extending along an axis X–X'.

At the level of the first end 314, panel 211 is equipped with an extension 313 which reaches along an axis Y–Y' which is globally perpendicular to axis X–X' and to the plane of panel 211. Extension 313 consists of two parts 3131 and 3132 which are cut into a globally cylindrical envelope surface and separated by a space or gap 3133 which is also inscribed into a cylindrical envelope surface.

Each part 3131 and 3132 is provided with a portion of the external radial flange 3131*a* and 3132*a*, of which the far side of panel 211 is in the shape of a truncated cone and converges opposite this panel. Two openings 3134 and 3135 are provided at the base of parts 3131 and 3132 for the passage of casting drawers for parts 3131 and 3132.

An opening 323 is provided at the level of a first end 324 of flap 212 and allows it to receive extension 313 and to lock it into position, in the same way as opening 123 of the first method of production allows extension 113 to be received and locked.

Edge 323*a* of opening 323 is in the shape of a truncated cone, which eases the introduction of extension 313.

Introduction of extension 313 into opening 323 takes place by elastic deformation of parts 3131 and 3132, which can be brought together by reduction of gap or volume 3133, when flanges 3131*a* and 3132*a* are passed into opening 323.

At end 315 of panel 211, opposite extension 313, this panel is provided with a tab 317 which projects, relative to the plane of panel 211 in the direction $Y_A$–$Y'_A$ parallel to direction Y–Y'. Tab 317 extends longitudinally in a direction Z–Z' perpendicular to axis X–X' and to direction $Y_A$–$Y'_A$.

Tab 317 is provided with a ridge 317*a* extending from one side, and whose upper surface 317*b* is inclined relative to the plane defined by axis X–X' from direction Z–Z'. The lower surface 317*c* of ridge 317*a*, i.e. the surface facing panel 211, is perpendicular to direction $Y_A$–$Y'_A$. An opening 318 is provided at the base of axis 317 for passage of a casting drawer.

Panel 212 features, at the level of its end 325 opposite end 324, an extension 326 in which a receiving and pinching groove 327 is provided for tab 317. Groove 327 is provided with an interior flange 327*b* for engagement by ridge 317*a* of tab 317 to immobilize tab 317 inside groove 327 when flap 210 is folded along hinge 213.

Part 327*a* of groove 327, which is shown more clearly in FIG. 7, is of width $\mathbf{1}_{327a}$ greater than width $\mathbf{1}_{327}$ of groove 327 at the level of flange 327*b*. This part 327*a* allows ridge 317*a* of tab 317 to be fitted in a closed configuration of tab 210, corresponding to the configuration of FIGS. 4 and 5 of tab 10 of the first method of production.

The flange 327 is defined between an inclined surface, consisting of a ridge introduction ramp 317*a* (this inclined surface is visible in FIG. 6), and a surface that is globally perpendicular to the plane of panel 212 (this surface is visible in FIG. 7).

Mounting of flap 210 on a package, such as carton 20, represented in FIGS. 2 to 5, takes place in a manner similar to that described for the first described embodiment.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A package having an upstanding edge, openable, in part to provide access to an interior of the package, the package including a clip element having first and second opposing, facing webs each of the web adapted to be disposed on either side of the edge, each of the webs having first and second ends, the clip element including means for connecting the webs to one another at their respective second ends, a flexible hinge joining the webs to one another, the flexible hinge extending substantially between the first and second ends, and an extension extending from one of the webs proximal to the first end in a direction substantially perpendicular to a plane of the web, the extension being configured for insertion into a passage formed in the edge, the extension defining a pivot axis, the other of the webs including a receiving element for receiving the extension to secure the first and second webs to one another, wherein the clip is pivotable about the pivot axis, substantially perpendicular to the edge, between a first position in which the clip covers the package edge and a second position in which the clip uncovers the package edge for opening a portion of the package edge, the pivot axis being spaced from the respective second ends of the webs.

2. The package in accordance with claim 1 wherein the package is formed as a gable top carton.

* * * * *